US008253755B2

(12) United States Patent
Russell et al.

(10) Patent No.: US 8,253,755 B2
(45) Date of Patent: Aug. 28, 2012

(54) SYSTEM AND METHOD FOR IMAGE-BASED COLOR SEQUENCE REALLOCATION

(75) Inventors: Andrew Ian Russell, Plano, TX (US); David Foster Lieb, Dallas, TX (US); Jeffrey Matthew Kempf, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1051 days.

(21) Appl. No.: 11/851,916

(22) Filed: Sep. 7, 2007

(65) Prior Publication Data

US 2009/0066718 A1 Mar. 12, 2009

(51) Int. Cl.
*G09G 5/02* (2006.01)

(52) U.S. Cl. ..... 345/589; 345/88; 345/581; 345/590; 345/595

(58) Field of Classification Search ..... 345/589–604, 345/88, 581, 690; 358/518–527; 353/31; 359/619–640; 349/106–108
See application file for complete search history.

(56) References Cited

U.S. PATENT DOCUMENTS

| | | | | |
|---|---|---|---|---|
| 5,903,323 | A * | 5/1999 | Ernstoff et al. | 348/771 |
| 5,921,650 | A * | 7/1999 | Doany et al. | 353/31 |
| 6,281,984 | B1 * | 8/2001 | Decker et al. | 358/1.9 |
| 6,511,182 | B1 * | 1/2003 | Agostinelli et al. | 353/7 |
| 6,520,648 | B2 * | 2/2003 | Stark et al. | 353/85 |
| 6,628,249 | B1 * | 9/2003 | Kamikawa et al. | 345/44 |
| 6,683,290 | B2 | 1/2004 | Doherty | |
| 6,724,354 | B1 | 4/2004 | Spitzer et al. | |
| 7,006,066 | B2 * | 2/2006 | Chen et al. | 345/90 |
| 7,088,321 | B1 | 8/2006 | Parker | |
| 2001/0022613 | A1 * | 9/2001 | Matsui et al. | 348/75 |
| 2002/0030649 | A1 * | 3/2002 | Zavracky et al. | 345/87 |
| 2002/0080262 | A1 * | 6/2002 | Haese et al. | 348/364 |
| 2003/0072016 | A1 * | 4/2003 | Dalrymple et al. | 358/1.9 |
| 2003/0128218 | A1 * | 7/2003 | Struyk | 345/581 |
| 2005/0128441 | A1 | 6/2005 | Morgan | |
| 2005/0243100 | A1 * | 11/2005 | Childers | 345/589 |
| 2005/0243282 | A1 * | 11/2005 | Peterson et al. | 353/31 |
| 2006/0012811 | A1 * | 1/2006 | Dalrymple et al. | 358/1.9 |
| 2006/0203107 | A1 * | 9/2006 | Steinberg et al. | 348/239 |
| 2006/0232717 | A1 * | 10/2006 | Kervec et al. | 348/761 |
| 2007/0171317 | A1 * | 7/2007 | Ho et al. | 349/6 |
| 2007/0247391 | A1 * | 10/2007 | Someya et al. | 345/7 |
| 2008/0143736 | A1 * | 6/2008 | Clatanoff et al. | 345/590 |

* cited by examiner

*Primary Examiner* — James A Thompson
*Assistant Examiner* — Abderrahim Merouan
(74) *Attorney, Agent, or Firm* — Charles A. Brill; Wade J. Brady, III; Frederick J. Telecky, Jr.

(57) ABSTRACT

System and method for image-based color sequence reallocation in sequential color display systems. A method comprises generating a color signal from an image to be displayed, wherein the color signal contains light intensity information, computing percentages of the color sequence to be allocated to each color in a set of colors in a sequential color display system, wherein the computing is based on the light intensity information, allocating the color sequence based on the computed percentages, and displaying the image using the color sequence. The allocation of the color sequence based on the image allows for the elimination of color intensities that are greater than needed in displaying the image. Portions of the color sequence formerly used to display the eliminated color intensities may be used to display colors with usable intensities, thereby increasing the brightness of images.

16 Claims, 5 Drawing Sheets

600

MINIMIZE (R + G + B + C + Y + M + W)

SUBJECT TO:

606

MAX (g) <= G+C+Y+W
MAX (r) <= R+M+Y+W
MAX (b) <= B+M+C+W
MAX (g-r) <= G+C
MAX (r-g) <= R+M
MAX (r-b) <= R+Y
MAX (b-r) <= B+C
MAX (g-b) <= G+Y
MAX (b-g) <= B+M
MAX (r-g-b) <= R
MAX (b-r-g) <= B
MAX (g-r-b) <= G
MAX (g+b-r) <= G+2C+B+W
MAX (g+r-b) <= G+R+2Y+W
MAX (r+b-g) <= R+B+2M+W
R, G, B, C, Y, M, W >= 0

605

607

*Fig. 6a*

650

MAXIMIZE (GAIN)

SUBJECT TO:

655

GAIN*MAX (g) -G-C-Y-W <= 0
GAIN*MAX (r) -R-M-Y-W <= 0
GAIN*MAX (b) -B-M-C-W <= 0
GAIN*MAX (g-r) -G-C <= 0
GAIN*MAX (r-g) -R-M <= 0
GAIN*MAX (r-b) -R-Y <= 0
GAIN*MAX (b-r) -B-C <= 0
GAIN*MAX (g-b) -G-Y <= 0
GAIN*MAX (b-g) -B-M <= 0
GAIN*MAX (r-g-b) -R <= 0
GAIN*MAX (b-r-g) -B <= 0
GAIN*MAX (g-r-b) -G <= 0
GAIN*MAX (g+b-r) -G-2C-B-W <= 0
GAIN*MAX (g+r-b) -G-R-2Y-W <= 0
GAIN*MAX (r+b-g) -R-B-2M-W <= 0
R+G+B+C+Y+M+W <= 1
R, G, B, C, Y, M, W >= 0

660

R+M+Y+W <= MAX_R_LASER_DUTY_CYCLE
G+C+Y+W <= MAX_G_LASER_DUTY_CYCLE
B+C+M+W <= MAX_B_LASER_DUTY_CYCLE

*Fig. 6b*

$$R = MAX\ (r-g-b)$$
$$B = MAX\ (b-r-g)$$
$$G = MAX\ (g-r-b)$$
$$C = MAX\ [MAX(g-r) - G,\ MAX(b-r) - B]$$
$$M = MAX\ [MAX(r-g) - R,\ MAX(b-g) - B]$$
$$Y = MAX\ [MAX(r-b) - R,\ MAX(g-b) - G]$$
$$\begin{aligned} W = MAX\ [&MAX(g) - G - C - Y, \\ &MAX(r) - R - M - Y, \\ &MAX(b) - B - M - C, \\ &MAX(g+b-r) - G - 2C - B, \\ &MAX(g+r-b) - G - R - 2Y, \\ &MAX(r+b-g) - R - B - 2M] \end{aligned}$$
*Fig. 7*
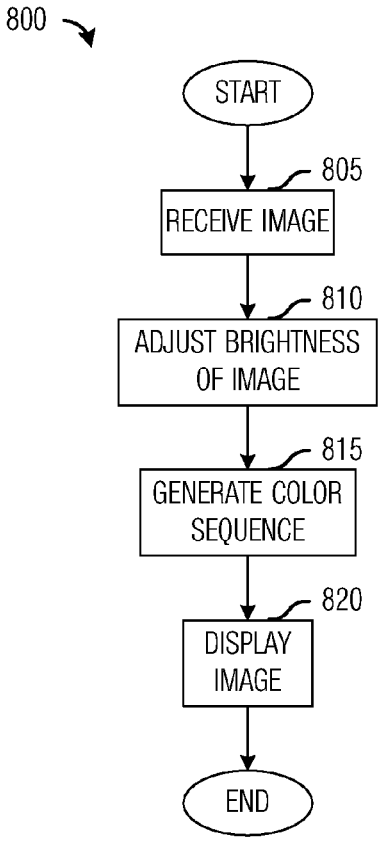
*Fig. 8a*
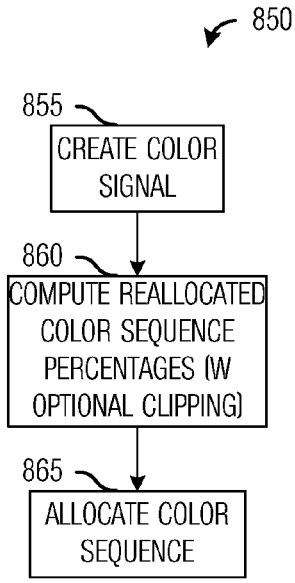
*Fig. 8b*

SYSTEM AND METHOD FOR IMAGE-BASED COLOR SEQUENCE REALLOCATION

RELATED PATENT APPLICATION

This patent application is related to co-assigned patent application entitled "Adaptive Pulse-Width Modulated Sequences for Sequential Color Display Systems," filed Sep. 7, 2007, Ser. No. 11/851,921, which is hereby incorporated herein by reference.

TECHNICAL FIELD

The present invention relates generally to a system and method for displaying images, and more particularly to a system and method for image-based color sequence reallocation in sequential color display systems.

BACKGROUND

Sequential color display systems generally display colors one at a time. For example, in a three-color RGB sequential color display system, a first color displayed may be red (R), followed by a second color, such as green (G), and then followed by a third color, such as blue (B). The three-color RGB sequential color display system may then continually repeat the RGB color sequence or display a different color sequence, such as BGR, RBG, and so on. The sequentially displayed colors may then be used in the displaying of images.

In a sequential color display system using a microdisplay commonly referred to as a digital micromirror device (DMD), image data corresponding to a color of light being displayed may be provided to the DMD. The image data may be used to set the state (position) of the plurality of micromirrors in the DMD, wherein when a micromirror is in a first state (e.g., an ON state), the light being displayed may be reflected onto a display plane and when a micromirror is in a second state (e.g., an OFF state), the light may be reflected away from the display plane. When a different color of light or light of the same color but at a different intensity is being displayed, image data corresponding to the different color of light or light intensity may be provided to the DMD. A viewer's visual system generally will integrate the sequentially displayed image data to form images.

A color sequence may be designed so that colored light of various intensities (brightness) may be displayed. The color sequence thereby enables the displaying of generally the entirety of a range of light intensities displayable by a sequential color display system. For example, a color sequence may contain a binary weighted sequence of light intensities, ranging from a low light intensity of about $2^0$ to a high light intensity of about $2^N$. This may enable the displaying of light intensities ranging from a low of about $2^0$ to a high of about $2^{N+1}-1$. When there is a need to display a light of a given intensity on the display plane, light modulators in the microdisplay may be configured to direct a combination of the appropriate light intensities onto the display plane. For example, if there is a need to display a light intensity of 19 (binary 10011) in a DMD-based sequential color display system, then a micromirror may be configured to be in the ON state (to reflect light onto the display plane) when the color sequence specifies that light intensities of about $2^0$, $2^1$, and $2^4$ are provided by the light source. The viewer's visual system may then integrate the three light intensities into a single light intensity of 19.

SUMMARY OF THE INVENTION

These and other problems are generally solved or circumvented, and technical advantages are generally achieved, by embodiments of a system and a method for image-based color sequence reallocation in sequential color display systems.

In accordance with an embodiment, a method for generating a color sequence for a sequential color display system is provided. The method includes generating a color signal from an image to be displayed, computing percentages of the color sequence to be allocated to each color in a set of colors used in the sequential color display system, allocating display times of the color sequence based on the computed percentages, and displaying the image using the color sequence. The color signal contains light intensity information and the computing is based on light intensity information used to display the image.

In accordance with another embodiment, a method for displaying an image with increased brightness is provided. The method includes receiving the image, adjusting a brightness of the image, generating the color sequence based on the adjusted brightness of the image, and displaying the image using the color sequence. The image including a range of light intensities for each color used to display the image and the adjusting modifies a color sequence so that the color sequence provides colored light with each color of light in a range of light intensities that substantially encompasses the range of light intensities.

In accordance with another embodiment, a display system is provided. The display system includes a light source, a light modulator optically coupled to the light source and positioned in a light path of the light source, an input providing an image to display, and a controller electronically coupled to the light modulator and the light source. The light modulator configured to produce images on a display plane by modulating light from the light source based on image data, and the controller configured to load image data from the image into the light modulator and to provide command to the light source, the controller comprising a color sequence reallocation unit, the color sequence reallocation unit configured to reallocate percentages of color display time based on maximum light intensities of colors in the image An advantage of an embodiment is that image brightness may be increased using existing hardware in a sequential color display system. Therefore, very little additional development or product cost may be incurred while potentially significantly increasing image quality. Furthermore, since the hardware required may already exist in current sequential color display system designs, existing display systems may be upgraded without modifying a customer's display system.

A further advantage of an embodiment is that image brightness may be increased dynamically, wherein the brightness of most or all images may be increased to an optimum or near optimum level without dependence on other images previously or subsequently displayed.

The foregoing has outlined rather broadly the features and technical advantages of the present invention in order that the detailed description of the embodiments that follow may be better understood. Additional features and advantages of the embodiments will be described hereinafter which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the embodiments, and the advantages thereof, reference is now made to the following descriptions taken in conjunction with the accompanying drawings, in which:

FIGS. 6*a* and 6*b* are diagrams of objectives and constraints for computing percentages of a color sequence for colors in the color sequence;

FIG. 7 is a diagram of a deterministic approximation for computing percentages of a color sequence for colors in the color sequence; and FIGS. 8*a* and 8*b* are diagrams of sequences of events in displaying an image in a sequential color display system.

DETAILED DESCRIPTION OF ILLUSTRATIVE EMBODIMENTS

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The embodiments will be described in a specific context, namely a DMD-based sequential color display system. The invention may also be applied, however, to other sequential color display systems, such as microdisplay-based projection display systems that use sequential colors, such as projection display systems utilizing deformable micromirrors, transmissive and reflective liquid crystal, liquid crystal on silicon, ferroelectric liquid-crystal-on-silicon, and so forth, microdisplays. Furthermore, the invention may be applied to direct-view sequential color display systems, such as some liquid crystal displays.

Figure 1A:
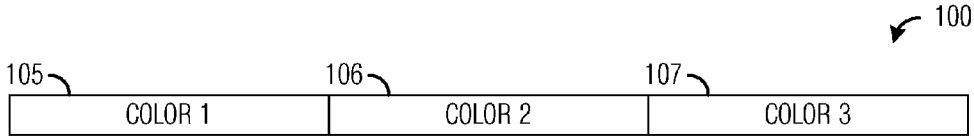
FIG. 1*a* is a diagram of an exemplary color sequence.

With reference now to FIG. 1*a*, there is shown a diagram illustrating an exemplary color sequence 100. The color sequence 100 illustrates an amount of time allocated to each color in the color sequence. As shown, the color sequence 100 includes three colors, a first color display time "color 1" 105, a second color display time "color 2" 106, and a third color display time "color 3" 107. As shown, the time of the color sequence 100 may be substantially evenly distributed between the three colors. However, color sequences may exist wherein the time of the color sequences is not evenly distributed between the colors in the color sequence. For example, if one particular color's light source is dimmer than the light source of the other colors, the time allocated to the dim color may be longer than the time allocated to the colors with more powerful light sources. In general, the time allocated to the colors in the color sequence may be dependent on factors such as color source power, desired color point, operating environment, and so forth.

Figure 1B:
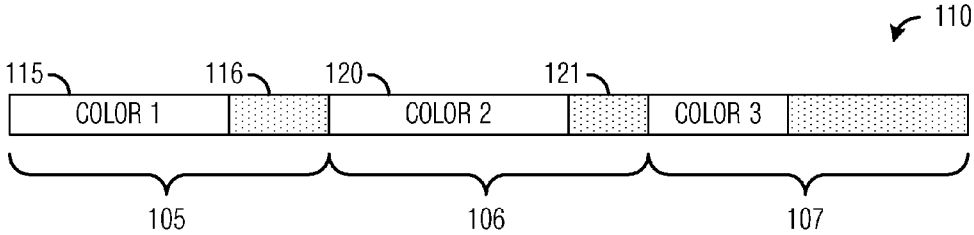
FIGS. 1*b* and 1*c* are diagrams of unused color display time in the exemplary color sequence shown in FIG. 1*a;*
Figure 1C:
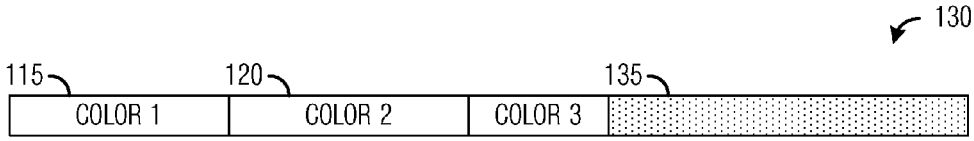

FIG. 1*b* illustrates a color sequence 110 with portions of the color display time actually used to display image data highlighted. Although a color sequence, such as the color sequence 100, may result in a providing of the colors in the color sequence 100 by a light source for a specified amount of time, depending on the image being displayed, not all of the colored light being provided by the light source may be used to display image data. As shown in the color sequence 110, in a duration dedicated to the providing of color 1, the first color display time 105, only a first portion of the first color display time 105 (shown as highlight 115) may be used to display image data while a second portion of the first color display time 105 (shown as highlight 116) may be left unused. Similarly, a third portion (highlight 120) of the display time for the display of color 2 may be used with a fourth portion (highlight 121) being left unused. FIG. 1*c* illustrates a reorganized color sequence 130 with the portions of the display time of colored light being moved to a beginning of the color sequence 130 and an unused display time (highlight 135) that may be a combination of the unused display times for each of the colors in the color sequence 110.

In a DMD-based sequential color display system, because colored light provided by a light source during the unused display time 135 is reflected away from a display plane, the image displayed using the color sequence 100 may be visually identical to the image displayed with color sequence 130.

Figure 2:
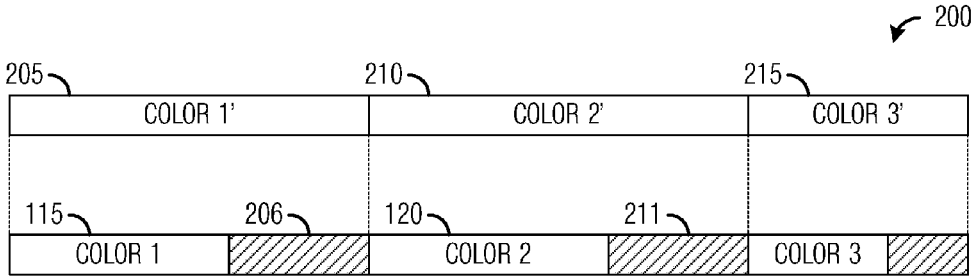
FIG. 2 is a diagram of an adjusted color sequence.

It may be possible to allocate some or all of the unused display time 135 to colors of light actually being used to display image data. This may result in displayed images with greater brightness and better image quality. FIG. 2 displays a reallocated color sequence 200 wherein the display time has been reallocated so that unused colors of light are not provided by the light source while their formerly allocated display times have been reassigned to the providing of colors of light that are used to display image data. The reallocated color sequence 200 includes display times for color 1' 205, color 2' 210, and color 3' 215. The display time for color 1' 205 comprises the first color display time 115 plus a portion of the unused display time 135 (shown as highlight 206). Similarly, the display time for color 2' 210 comprises the second color display time 120 plus a portion of the unused display time 135 (highlight 211).

The amount of the unused display time 135 reallocated to the display of each of the colors in the color sequence may be performed so as to meet selected constraints or objectives, for example, the reallocation of the unused display time 135 may be performed so that the color point of the image is preserved. In general, the unused display time 135 preferably is not simply partitioned equally to the display time for each color of the color sequence, although it could be.

Figure 3:
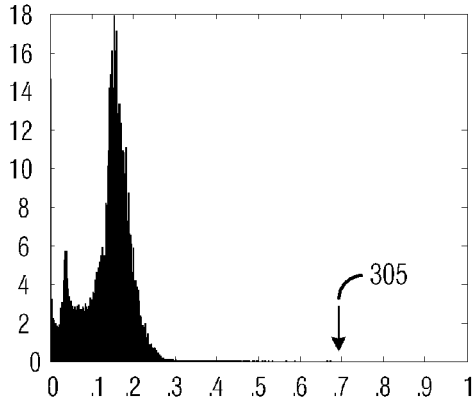
FIG. 3 is a diagram of a histogram of a color of an image.

The unused display time 135 may arise from the color sequence providing all displayable intensities for each color used in the sequential color display system. However, not all images will make use of the entire range of displayable intensity of a color. For example, in dim images with a significant percentage of black or gray, the vast majority of pixels may have light intensities significantly below 25 to 30 percent of a maximum intensity. FIG. 3 displays a histogram of pixels from an exemplary image for a single color, for example, the color red. The histogram shows that more than 95 percent of the pixels have a light intensity that is less than 0.30 of the maximum intensity and no pixel has a light intensity greater than 0.70 of the maximum intensity (shown as pointer 305). Therefore, a color sequence that specifies the providing of red colored light by a light source with intensities greater than 0.70 of the maximum intensity may be wasting valuable display time. The display time dedicated to the providing of light with intensities greater than required in the display of an image may be reallocated to the providing of light with intensities within a useful range, typically less than a maximum light intensity actually used in the displaying of the image, thereby increasing the overall brightness of the image being displayed.

Figure 4A:
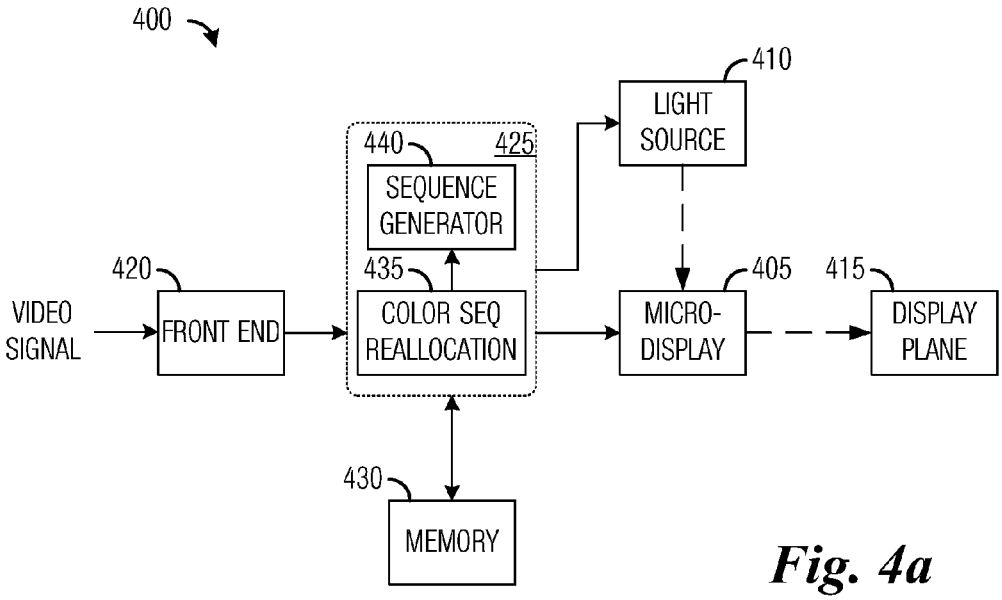
FIG. 4*a* is a diagram of a sequential color display system.

FIG. 4*a* illustrates a high level view of a microdisplay-based sequential color projection display system 400, wherein the microdisplay-based sequential color projection display system 400 dynamically performs image-based color sequence reallocation. The microdisplay-based sequential color projection display system 400 utilizes an array of light modulators, more specifically, a microdisplay 405, wherein individual light modulators in the microdisplay 405 assume a state corresponding to image data for an image being displayed by the microdisplay-based sequential color projection display system 400. The microdisplay 405 may be a digital micromirror device (DMD) with each light modulator being a positional micromirror. For example, in a DMD-based sequential color projection display system 400, light from a light source 410 may either be reflected away from or towards a display plane 415 based on image data of an image being displayed. A combination of the reflected light from the light modulators in the DMD 405 produces an image corresponding to the image data. Other examples of microdisplays may include deformable micromirrors, transmissive and reflective liquid crystal, liquid crystal on silicon, ferroelectric liquid-crystal-on-silicon, direct view liquid crystal, and so forth.

A front end unit 420 may perform operations such as converting analog input signals into digital, Y/C separation, automatic chroma control, and so forth, on an input video signal. The front end unit 420 may then provide the processed video signal, which may contain image data from images to be displayed, to a controller 425. The controller 425 may be an application specific integrated circuit (ASIC), a general purpose processor, and so forth, and may be used to control the general operation of the projection display system 400. In addition to controlling the operation of the microdisplay-based sequential color projection display system 400, the controller 425 may be used to process the signals provided by the front end unit 420 to help improve image quality. For example, the controller 425 may be used to perform color correction, adjust image bit-depth, color space conversion, and so forth. A memory 430 may be used to store image data, sequence color data, and other information used in the displaying of images.

The controller 425 may include a color sequence reallocation unit 435 that may be used to reallocate display times for different colors of light in a color sequence based on an image-by-image basis. The color sequence reallocation unit 435 may perform an analysis of the pixels in an image and adjust the different colors of light in a color sequence so that colors of light not needed in the displaying of the image are not provided by the light source 410. For example, if a color sequence may allow for the displaying of various intensities of a given color ranging from intensity zero (0) to intensity 100, and, if in the image, a maximum needed intensity in the given color is 72, then the color sequence may be adjusted so that intensities 73 through 100 for the color are not provided by the light source 410. Furthermore, the display times previously allocated for the providing of the colored light with intensities 73 through 100 may be reallocated to other colors in the color sequence on an as needed basis.

The controller 425 may also include a sequence generator 440 that may be used to generate (or select) a color sequence that may result in the light source providing the colored lights as reallocated by the color sequence reallocation unit 435. For example, the sequence generator 440 may receive a description of the reallocated color sequence (or the actual reallocated color sequence) and create light control commands that may be provided to the light source 410. The light control commands may be directly provided to the light source 410 so that the light source 410 may produce the desired colors of light, or the light control commands may be provided to a light driver unit that may convert the light control commands into drive currents that may be provided to the light source 410. Alternatively, the sequence generator 440 may use the description of the reallocated color sequence and retrieve light control commands that match (or closely match) the description of the reallocated color sequence from a memory, such as the memory 430.

Figure 4B:
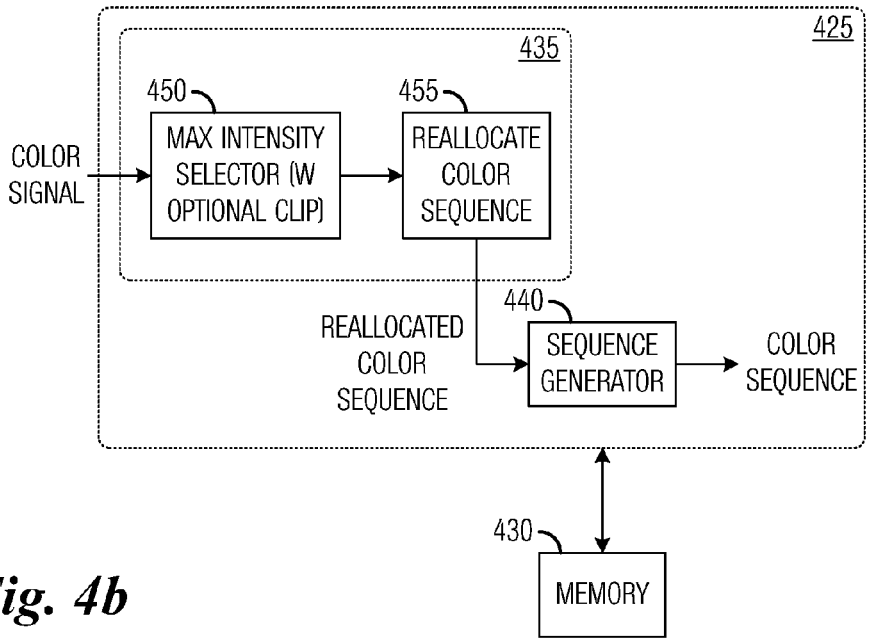
FIG. 4*b* is a diagram of a controller of a sequential color display system.

FIG. 4*b* illustrates a detailed view of the controller 425 with emphasis provided on the color sequence reallocation unit 435 and the sequence generator 440. A color signal provided by the front end unit 420 may contain color information from an image being displayed. The color signal may be provided to the color sequence reallocation unit 435 of the controller 425. The color sequence reallocation unit 435 may include a maximum intensity selector 450. The maximum intensity selector 450 may determine a maximum intensity for each color used in the displaying of the image.

In many instances, a significant majority of pixels of an image may be concentrated below a certain light intensity level with a much smaller number of pixels of the image having higher light intensity levels. An example of this behavior may be seen in the histogram shown in FIG. 3, wherein more than 95 percent of the pixels have a light intensity of less than 0.30 of the maximum intensity, while no pixel has a light intensity of more than 0.70 of the maximum intensity. Therefore, if a specified percentage of the pixels are allowed to clip, it may be possible to further reduce the maximum intensity for each color used in the displaying of the image. When a pixel is clipped, it may be displayed as a full intensity pixel rather than its actual intensity, wherein the full intensity pixel is whatever has been determined as the maximum intensity. For example, if the full intensity selected for the pixels shown in FIG. 3 is at 0.60 of the maximum intensity, then the pixels with intensity greater than 0.60 of the maximum intensity may be clipped and may be displayed at the full intensity level (0.60 of the maximum intensity). The clipping may be an optional operation since some image information is lost, which may impact image quality. However, if the clipping is set at a low level so that only a relatively small number of pixels are affected, then the impact on image quality may be very hard to detect visually.

The color sequence reallocation unit 435 may also include a reallocate color sequence unit 455 to reallocate the display times for each color in the color sequence. The reallocation of display times in the color sequence may be based on a difference between the maximum intensity for each color used in the displaying of the image and the maximum light intensity for each color producible by the microdisplay-based sequential color projection display system 400. If the maximum intensity for a given color in the image is less than the maximum light intensity producible by the microdisplay-based sequential color projection display system 400 for the given color, then the display time for the given color spent providing light intensities greater than the maximum intensity for a given color in the image is wasted. The reallocate color sequence unit 455 adjusts the color sequence so that the color sequence may cause the light source 410 to produce a maximum intensity that may be substantially equal to the maximum intensity for a given color in the image. Thereby, the formerly wasted display time may be devoted to providing colors that may actually be used in displaying the image.

Figure 5A:
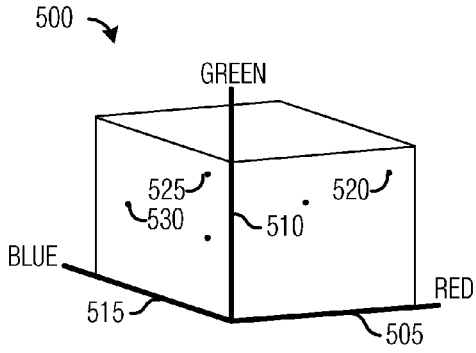
FIGS. 5*a* and 5*b* are diagrams of a color-cube of a three-color RGB sequential color display system.
Figure 5B:
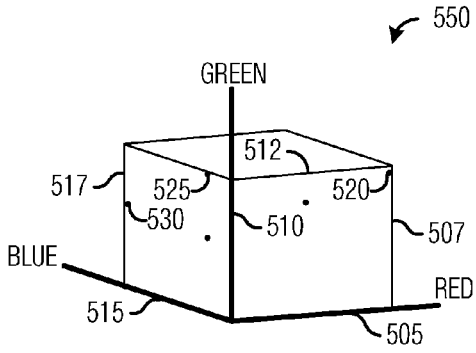
Figure 5C:
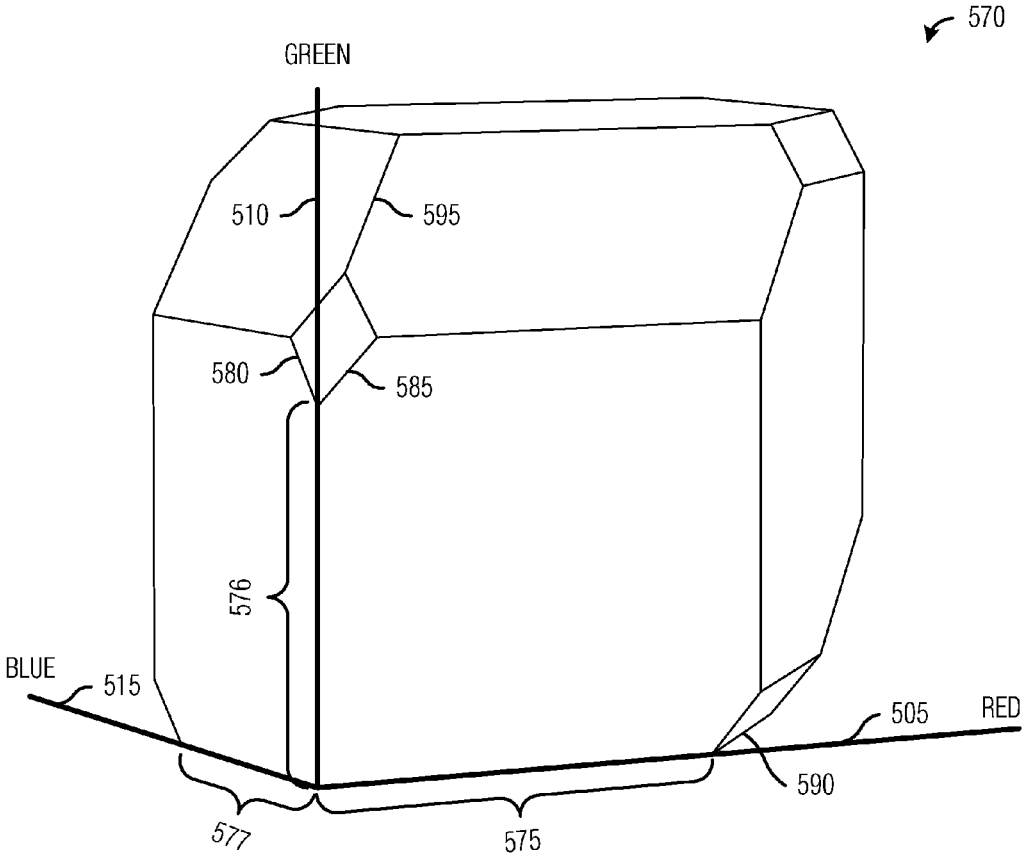
FIG. 5*c* is a diagram of a color-polyhedron of a seven-color RGBCMYW sequential color display system.

The operation of the maximum intensity selector 450 and the reallocate color sequence unit 455 may be described visually as shown in FIGS. 5*a* through 5*c*. FIG. 5*a* illustrates a color-cube 500 representing the displayable colors in a three-color RGB sequential color display system. Each of the three colors may be represented by an axis originating at a corner (an origin) of the color-cube 500, with a first axis 505 representing the color red, a second axis 510 representing the color green, and a third axis 515 representing the color blue. The intensities of each of the three colors increase as the distance from the origin of the axes increases. A maximum intensity for each color is represented by the edges of the color-cube 500. Shown in the color-cube 500 are some pixels representing image data, such as pixel 520, 525, and 530. The pixels may be internal to the color-cube 500 or on a surface of the color-cube 500, depending on the image data.

Since none of the pixels shown in FIG. 5*a* are along an edge of the color-cube 500 representing a maximum light intensity, none of the pixels require the three-color RGB sequential color display system to display its entire range of light intensities. Therefore, it may be possible for the three-color RGB sequential color display system to adjust its color sequence so that the maximum provided light intensity may correspond to a maximum light intensity required to display the image data of the image. FIG. 5*b* illustrates a color-cube 550 wherein the color-cube 550 has been adjusted so that the maximum light intensity displayed by the three-color RGB sequential color display system corresponds to the maximum light intensity required by the image data. The edges of the color-cube 550 have been moved towards the origin of the color-cube 550 so that the edges are about equal to pixels of the image that require maximum light intensity. For example, edge 507 corresponding to a maximum light intensity for the color red, may be moved in towards pixel 520. Similarly, edge 512 (a maximum light intensity for the color green) may be moved in towards pixel 525, and edge 517 (a maximum light intensity for the color blue) may be moved in towards pixel 530. The values of the edges 507, 512, and 517, may now correspond to a maximum provided light intensity for an adjusted color sequence that may be used to display the pixels 520, 525, and 530.

Sequential color display systems with a larger number of colors, such as a seven-color RGBCYMW sequential color display system, may have similar geometric shapes representing the displayable colors of the respective sequential color display system. FIG. 5*c* displays a color-polyhedron 570 representing the displayable colors of a seven-color RGBCYMW sequential color display system. The dimensions of the color-polyhedron 570 may be used to determine characteristics of a color sequence used to provide colored light for pixels lying within the color-polyhedron 570. For example, the edge lengths of the color-polyhedron 570 along the three color axes 505, 510, and 515 (shown as spans 575, 576, and 577) may specify a light intensity range for each of the three colors red, green, and blue. Similarly, dimensions of other edges on the color-polyhedron 570 may be used to determine the color sequence characteristics for the remaining four colors, CYMW.

An edge 580 of the color-polyhedron 570 on a surface formed between the green color axis 510 and the blue color axis 515 may specify a light intensity range for the color cyan (C). Similarly, an edge 585 on a surface formed between the red color axis 505 and the green color axis 510 may specify a light intensity range for the color yellow (Y) and an edge 590 on a surface formed between the red color axis 505 and the blue color axis 515 may specify a light intensity range for the color magenta (M). An edge 595 may specify a light intensity range for the color white (W).

Although FIGS. 5*a* through 5*c* illustrate color-polyhedrons for a three-color RGB and a seven-color RGBCYMW sequential color display system, similar color-polyhedrons may be illustrated for sequential color display systems of different numbers of colors and different specific colors. For example, two-color, three-color, four-color, five-color, six-color, seven-color, and greater may all have color-polyhedrons. Other examples of sequential color display systems may include CYM, RGBW, CYMW, RGBCYM, and so forth. Therefore, the discussion of three-color RGB and seven-color RGBCYMW sequential color display systems should not be construed as being limiting to either the scope or the spirit of the embodiments.

With reference back to FIG. 4*b*, after the color sequence has been reallocated based on the maximum intensities for each color used in the displaying of the image, the sequence generator 440 may be used to create a color sequence matching the reallocated color sequence. The newly generated color sequence may then be provided to the light source 410 and used to produce light of appropriate color and intensity.

The computations of the maximum intensity selector unit 450 and the reallocate color sequence unit 455 may be performed mathematically by solving a linear programming (LP) problem. In an LP problem, the computations may be expressed as objectives to be solved subject to a set of constraints. FIG. 6*a* illustrates an expression of an LP program of the computations performed by the maximum intensity selector unit 450 and the reallocate color sequence unit 455. An objective 600 to be solved may be expressed as:

$$\text{MINIMIZE}(R+G+B+C+Y+M+W),$$

where R, G, B, C, Y, M, and W are percentages of a color sequence for respective colors (red, green, blue, cyan, yellow, magenta, and white) in a seven-color RGBCYMW sequential color display system. The percentage of a color sequence for a respective color may also be referred to as the respective color's duty cycle.

The objective 600 may be solved subject to a set of constraints 605. The constraints 605 may limit the reduction of the objective 600. For example, a constraint 606, $MAX(g)<=G+C+Y+W$, ensures that a maximum green intensity value for all pixels is less than or equal to a sum of the percentages for G (green percentage), C (cyan percentage), Y (yellow percentage), and W (white percentage). If pixel value clipping is utilized, then the constraint 605 ensures that a maximum green intensity value for unclipped pixels is less than or equal to a sum of the percentages for G, C, Y, and W. Another constraint 607, $MAX(g+b-r)<=G+2C+B+W$, ensures that a maximum pixel value for colors green plus blue minus red is less than or equal to a sum of the percentages for G, two times C, B, and W.

The objective 600 and the set of constraints 605 may be solved using the Simplex Algorithm, a widely known technique for solving linear programs. The use of the Simplex Algorithm generally yields an optimum solution for the linear program. In addition to the Simplex Algorithm, other techniques for solving linear programs include the Nelder-Mead method and the Fourier-Motzkin elimination technique. These techniques for solving linear programs are considered to be well understood by those of ordinary skill in the art and will not be discussed further herein.

The computations of the maximum intensity selector unit 450 and the reallocate color sequence unit 455 may also be formulated in other ways. FIG. 6*b* illustrates an alternate expression of an LP program of the computations performed by the maximum intensity selector unit 450 and the reallocate color sequence unit 455. An objective 650 to be solved may be expressed as:

MAXIMIZE(GAIN)

where GAIN is a brightness boost resulting from certain sets of RGBCMYW cycles and is a linear programming variable.

The objective 650 may be solved subject to a set of constraints 655 as well as a set of optional constraints 660. The set of constraints 655 may be similar in nature to the set of constraints 605, while the set of optional constraints 660 may be used to help ensure that the various color duty cycles remain less than or equal to a maximum duty cycle for a respective color's light source. The set of optional constraints 660 help to ensure that the light sources may not be overextended, i.e., driven beyond their capabilities. The objectives and sets of constraints shown in FIGS. 6*a* and 6*b* represent two exemplary formulations (linear programs) of the linear programming problem of reallocating the percentages of the colors in the color sequence. Other formulations may be possible. Therefore, the discussion of the two formulations should not be construed as being limiting to either the scope or the spirit of the embodiments.

In some circumstances, it may not be possible to find an optimum solution for the objectives 600 and 650 subject to the constraints 605, 655, and 660 in real-time. This may be due to available processing power, a desired image display rate, power consumption requirements, and so forth. Therefore, a less computationally intensive solution may be needed. FIG. 7 displays a deterministic approximation for computing a maximum intensity for each color used to display an image based on image data of the image in a seven-color RGBCYMW sequential color display system. The maximum intensity for each color may be found using a computation for each color. Other deterministic approximations may be available, each deterministic approximation may vary in the quality of the approximation (how close the approximation is to an optimum solution), the amount of computation required to compute the approximation, the amount of memory required, and so forth. The selection of a deterministic approximation to utilize may depend on a desired quality of the approximation, the amount of available computing power, and so on.

The percentage of a color sequence allocated to primary colors, such as red, green, and blue, which may be used as the axes of a color-polyhedron representing the displayable color intensities for a sequential color display system, may be computed by determining a maximum difference between intensity values of the primary colors. For example, the percentage of a color sequence for the color red (R) may be determined using expression R=MAX (r−g−b), where r, g, and b are actual pixel intensity values. In general, the percentage of a color sequence for a primary color PCA may be expressed as:

$$PCA_\% = \mathrm{MAX}(PCA_\mathrm{pixel_intensity} - \mathrm{SUM}(\mathrm{other_primary_color_pixel_intensities})),$$

where other_primary_color_pixel_intensities are pixel color intensities for remaining primary colors other than primary color A, and MAX provides a largest value for all pixels in the image being displayed or for all pixels after elimination of clipped pixels.

The percentage of a color sequence allocated to multiprimary colors, such as cyan, magenta, and yellow, which may be combinations of two primary colors, may be computed by determining a maximum of two values. In general, the percentage of a color sequence allocated for a multiprimary color MCA, which may be a combination of primary colors PC1 and PC2, may be expressed as:

$$MCA_\% = \mathrm{MAX}^*[\mathrm{MAX}(PC1_\mathrm{pixel_intensity} - PC3_\mathrm{pixel_intensity}) - PC1_\%, \mathrm{MAX}(PC2_\mathrm{pixel_intensity} - PC3_\mathrm{pixel_intensity}) - PC2_\%],$$

where PC3 is a primary color not used to create the multiprimary color MCA and MAX* selects the larger of the two values. For example, with multiprimary color cyan, a combination of primary colors green and blue, the percentage of the color sequence for the color cyan may be expressed as:

$$C = \mathrm{MAX}[\mathrm{MAX}(g-r)-G, \mathrm{MAX}(b-r)-B].$$

For colors that are combinations of primary colors and multiprimary colors, such as white, which may be a combination of every color in the sequential color display system (not including the color in question), the percentage of a color sequence allocated to such colors may be computed by determining a maximum of all colors in the sequential color display system. For example, for the color white in a seven-color RGBCYMW sequential color display system, the percentage of a color sequence allocated to the color white may be expressed as:

$$W = \mathrm{MAX}^*[\mathrm{MAX}(g)-G-C-Y, /^*\text{maximum green pixel intensity } \mathrm{MAX}(r)-R-M-Y, /^*\text{maximum red pixel intensity } \mathrm{MAX}(b)-B-M-C, /^*\text{maximum blue pixel intensity } \mathrm{MAX}(g+b-r)-G-2C-B, /^*\text{maximum cyan pixel intensity } \mathrm{MAX}(g+r-b)-G-R-2Y, /^*\text{maximum yellow pixel intensity } \mathrm{MAX}(r+b-g)-R-B-2M]/^*\text{maximum magenta pixel intensity}.$$

Similar deterministic solutions may be available for sequential color display systems utilizing different numbers of colors and/or different colors. For example, a seven-color sequential color display system may utilize colors other than RGBCMYW, while other sequential color display systems may utilize a different number of colors. The discussion of a seven-color RGBCYMW sequential color display system should not be construed as being limiting to either the scope or the spirit of the embodiments.

FIG. 8*a* illustrates a sequence of events 800 in the displaying of an image with increased image brightness in a sequential color display system 400. The displaying of an image in the sequential color display system 400 may begin with a receiving of the image to display (block 805). The image may be a part of a stream of images provided by an input port connected to a signal source, such as a DVD player, magnetic tape player, over-the-air broadcast signal, satellite broadcast signal, data network distributed video stream, and so on. The image may then have its brightness adjusted to potentially increase the brightness of the image (block 810).

A majority of images may not make full use of an entire range of color intensities displayable by the sequential color display system 400, therefore, it may be possible to reallocate a color sequence used to display the image so that the greatest color intensities are determined by actual pixel color intensities in the image. This may free up some display time in the color sequence, which may be reallocated to increase display times of color intensities that are actually used, thereby increasing the brightness of the image. The reallocation of a color sequence, and thereby, adjusting the brightness of the image, may be performed by the color sequence reallocate unit 435 of the sequential color display system 400. The brightness of the image may be further increased if clipping of some of the pixels with higher color intensities is permitted.

The reallocation of a color sequence may require a computation of percentages of a color sequence to be allocated to each color displayed by the sequential color display system 400. The computation of the percentages may be performed using an LP program and a linear program solution technique such as the Simplex Algorithm. Alternatively, the computation may be approximated deterministically using expressions, such as the deterministic approximation shown in FIG. 7 for a seven-color RGBCYMW sequential color display system.

After a color sequence has been reallocated by computing the percentages of each displayed color, a reallocated color sequence may be generated (block 815). The generation of the reallocated color sequence may involve the actual issuance of commands that may be provided to a light source to produce the colors in the reallocated color sequence. The generation of the reallocated color sequence may involve the ordering of the colors in the color sequence, the partitioning of large contiguous blocks of a single color in multiple small blocks that may be mixed with blocks of other colors to help reduce visual artifacts, and so on. Each color may be displayed in a contiguous block or the individual colors may be partitioned into smaller blocks of time and then mixed to help reduce visual noise and color artifacts. Refer to co-assigned patent application entitled "Adaptive Pulse-Width Modulated Sequences for Sequential Color Display Systems and Methods," filed Sep. 7, 2007, Ser. No. 11/851,921, for a detailed description of the generation of a reallocated color sequence.

With the reallocated color sequence generated, the image may then be displayed (block 820). Due to the sequential nature of the display system, the displaying of the image may occur in sequence. When the reallocated color sequence causes a light of particular color and intensity to be produced by a light source, a microdisplay, such as the microdisplay 405, may be loaded with image data associated with the particular color and intensity of light. As the colors and intensity changes, the microdisplay 405 may loaded with corresponding image data.

FIG. 8*b* illustrates a sequence of events 850 in the adjusting of the brightness of an image. The sequence of events 850 may be an implementation of the adjusting the brightness of an image, block 810, of the sequence of events 800. The adjusting may begin with creating color signal information from an image to be displayed (block 855). The image to be displayed may comprise of a number of pixels containing color information. The pixels may contain color information such as color, color intensity, and so forth. From the color information, color signal information such as maximum color intensity for each color needed to display the image, and so on, may be created. From the color signal information, percentages of a color sequence for each color needed to display an image may be computed (block 860). The percentages of the color sequence should be computed so that the color sequence produces colored light in a range of intensities that spans a range of light intensities needed to display the image. Typically, the range of light intensities may start at zero light (or near zero light). For example, the percentages of the color sequence may be computed using a linear program solution technique or a deterministic approximation. After the percentages of a color sequence for each color needed to display an image has been computed, an actual color sequence may be allocated (block 865).

Although the embodiments and their advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for generating a color sequence for a sequential color display system, the method comprising:

generating a color signal from an image to be displayed, wherein the color signal contains light intensity information;

computing percentages of the color sequence to be allocated to each color in a set of colors used in the sequential color display system, wherein the computing is based on light intensity information used to display the image;

allocating display times of the color sequence based on the computed percentages; and displaying the image using the color sequence;

wherein the computing comprises specifying an objective function, wherein the objective function is related to percentages for each color in the color sequence; and solving the objective function subject to a set of constraints; and wherein the objective comprises minimizing a sum of percentages for each color in the set of color.

2. The method of claim 1, wherein the image comprises a plurality of pixels, and wherein the color signal comprises a maximum color intensity for each color in the set of colors used to display the pixels of the image.

3. The method of claim 2, wherein the maximum color intensity excludes a specified percentage of pixels for each color with a highest light intensity.

4. The method of claim 1, wherein the sequential color display system comprises a seven-color RGBCYMK sequential color display system, and wherein the set of constraints comprises:

$$\text{maximum}(g)<=G+C+Y+W;$$

$$\text{maximum}(r)<=R+M+Y+W;$$

$$\text{maximum}(b)<=B+M+C+W;$$

$$\text{maximum}(g-r)<=G+C;$$

$$\text{maximum}(r-g)<=R+M;$$

$$\text{maximum}(r-b)<=R+Y;$$

$$\text{maximum}(b-r)<=B+C;$$

$$\text{maximum}(g-b)<=G+Y;$$

$$\text{maximum}(b-g)<=B+M;$$

$$\text{maximum}(r-g-b)<=R;$$

$$\text{maximum}(b-r-g)<=B;$$

$$\text{maximum}(g-r-b)<=G;$$

$$\text{maximum}(g+b-r)<=G+2C+B+W;$$

$$\text{maximum}(g+r-b)<=G+R+2Y+W;$$

$$\text{maximum}(r+b-g)<=R+B+2M+W; \text{ and}$$

$$R,G,B,C,Y,M,W>=0,$$

where maximum (color) returns a largest pixel value of color, r, g, b are pixel color intensities for the respective color, and R, G, B, C, Y, M, W are percentages of the color sequence for the respective color.

5. The method of claim 1, wherein the computing comprises computing a deterministic approximation.

6. The method of claim 5, wherein the sequential color display system comprises a seven-color RGBCYMW sequential color display system, and wherein the computing comprises:

$$\text{computing } R=\text{maximum}(r-g-b);$$

$$\text{computing } B=\text{maximum}(b-r-g);$$

$$\text{computing } G=\text{maximum}(g-r-b);$$

$$\text{computing } C=\max[\text{maximum}(g-r)-G,\text{maximum}(b-r)-B];$$

$$\text{computing } M=\max[\text{maximum}(r-g)-R,\text{maximum}(b-g)-B];$$

$$\text{computing } Y=\max[\text{maximum}(r-b)-R,\text{maximum}(g-b)-G]; \text{ and}$$

$$\text{computing } W=\max[\text{maximum}(g)-G-C-Y, \text{maximum}(r)-R-M-Y,\text{maximum}(b)-B-M-C, \text{maximum}(g+b-r)-G-2C-B, \text{maximum}(g+r-b)-G-R-2Y, \text{maximum}(r+b-g)-R-B-2M],$$

where maximum (color) returns a largest pixel value of color, max[a1, a2, . . . , an] returns the largest of a1, a2, . . . , an, r, g, b are pixel color intensities for the respective color, and R, G, B, C, Y, M, W are percentages of the color sequence for the respective color.

7. The method of claim 1, wherein generating of the color sequence is performed in real-time.

8. The method of claim 1, wherein the image is part of a sequence of images, and the method further comprises, after the displaying, repeating the generating, the computing, the allocating, and the displaying for other images in the sequence of images.

9. A method for generating a color sequence for a sequential color display system, the method comprising:

generating a color signal from an image to be displayed, wherein the color signal contains light intensity information;

computing percentages of the color sequence to be allocated to each color in a set of colors used in the sequential color display system, wherein the computing is based on light intensity information used to display the image;

allocating display times of the color sequence based on the computed percentages; and displaying the image using the color sequence;

wherein the computing comprises specifying an objective function, wherein the objective function is related to percentages for each color in the color sequence; and solving the objective function subject to a set of constraints; and wherein the objective comprises maximizing a gain, wherein the gain comprises a brightness boost in displaying the image utilizing a color sequence with specific percentages for each color in the color sequence.

10. A method for generating a color sequence for a sequential color display system, the method comprising:

generating a color signal from an image to be displayed, wherein the color signal contains light intensity information;

computing percentages of the color sequence to be allocated to each color in a set of colors used in the sequential color display system, wherein the computing is based on light intensity information used to display the image;

allocating display times of the color sequence based on the computed percentages; and displaying the image using the color sequence;

wherein the computing comprises:

plotting pixels forming the image in a color-polyhedron representing displayable colors in the sequential color display system; and reducing dimensions of the color-polyhedron so that the color-polyhedron is substantially a minimal size while still containing the pixels.

11. A method for displaying an image with increased brightness, the method comprising:

receiving the image, the image including a range of light intensities for each color used to display the image;

adjusting a brightness of the image, wherein the adjusting modifies a color sequence so that the color sequence provides colored light with each color of light in a range of light intensities that substantially encompasses the range of light intensities included in the image;

generating the color sequence based on the adjusted brightness of the image, wherein image brightness is increased dynamically without dependence on other images previously or subsequently displayed by reallocating display times previously allocated for light intensities not encompassed by the range of light intensities included in the image; and displaying the image using the color sequence.

12. The method of claim 11, wherein the adjusting comprises:

creating a color signal from the image, wherein the color signal includes a maximum color intensity for each color in the image; and computing a duty cycle for each color in the color sequence based on the color signal.

13. The method of claim 12, wherein the computing of duty cycles is expressible as a linear program, and wherein the computing comprises computing a deterministic approximation to the linear program.

14. The method of claim 11, wherein the displaying comprises displaying image data associated with a color of light being provided by the color sequence.

15. The method of claim 14, wherein the displaying further comprises displaying image data with intensity associated with an intensity of color of light being provided by the color sequence.

16. A display system comprising:

a light source;

a light modulator optically coupled to the light source and positioned in a light path of the light source, the light modulator configured to produce images on a display plane by modulating light from the light source based on image data;

an input providing an image to display; and a controller electronically coupled to the light modulator and the light source, the controller configured to load image data from the image into the light modulator and to provide command to the light source, the controller comprising a color sequence reallocation unit, the color sequence reallocation unit configured to reallocate percentages of color display time based on maximum light intensities of colors in the image;

wherein the color sequence reallocation unit comprises:

a maximum intensity selector unit configured to select a maximum light intensity for each color in the image; and a reallocate color sequence unit coupled to the maximum intensity selector unit, the reallocate color sequence configured to adjust a color sequence used to display the image based on the maximum light intensities for each color in the image; and wherein the maximum intensity selector unit further comprises an intensity clipper unit configured to select a maximum light intensity for each color in the image, wherein the maximum intensity excludes a specified percentage of picture elements with highest intensities.

* * * * *